US006626244B2

(12) United States Patent
Powers

(10) Patent No.: US 6,626,244 B2
(45) Date of Patent: Sep. 30, 2003

(54) DEEP-SET SUBSURFACE SAFETY VALVE ASSEMBLY

(75) Inventor: Jody Powers, Montgomery, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 14 days.

(21) Appl. No.: 09/949,330

(22) Filed: Sep. 7, 2001

(65) Prior Publication Data

US 2003/0047317 A1 Mar. 13, 2003

(51) Int. Cl.[7] ..... E21B 34/06

(52) U.S. Cl. ..... 166/373; 166/66.7; 166/242.7; 166/386

(58) Field of Search ..... 166/377, 380, 166/373, 386, 66.4, 66.7, 242.6, 242.7

(56) References Cited

U.S. PATENT DOCUMENTS

| | | | | | |
|---|---|---|---|---|---|
| 4,467,870 | A | | 8/1984 | Langham | |
| 4,619,323 | A | * | 10/1986 | Gidley | 166/285 |
| 4,649,993 | A | * | 3/1987 | Going, III | 166/66.6 |
| 4,798,247 | A | * | 1/1989 | Deaton et al. | 166/66.7 |
| 4,886,114 | A | | 12/1989 | Perkins et al. | |
| 4,981,173 | A | | 1/1991 | Perkins et al. | |
| 5,070,595 | A | | 12/1991 | Perkins et al. | |
| 5,070,944 | A | * | 12/1991 | Hopper | 166/66.7 |
| 5,257,663 | A | * | 11/1993 | Pringle et al. | 166/66.4 |
| 5,291,947 | A | * | 3/1994 | Stracke | 166/187 |
| 5,293,551 | A | | 3/1994 | Perkins et al. | |
| 5,299,640 | A | | 4/1994 | Streich et al. | |
| 5,913,337 | A | | 6/1999 | Williams et al. | |
| 6,016,845 | A | | 1/2000 | Quigley et al. | |
| 6,253,843 | B1 | * | 7/2001 | Rawson et al. | 166/66.7 |
| 6,361,299 | B1 | * | 3/2002 | Quigley et al. | 425/35.9 |
| 2002/0112861 | A1 | * | 8/2002 | Restarick et al. | 166/384 |

* cited by examiner

*Primary Examiner*—Hoang Dang
(74) *Attorney, Agent, or Firm*—John W. Wustenberg; Peter V. Schroeder

(57) ABSTRACT

An apparatus and method for use in a cased well having a production tubing assembly installed in the well and terminating with a connection mechanism at a subterranean location. The apparatus and method utilizes a spoolable tubular assembly for installation extending into the well to the connection mechanism wherein the tubular assembly has a plurality of conductors formed connected to electrically operable valve, sensors and tubing latch in the tubular assembly. In the method the assembly is spooled into the well with the tubing latch being operated from outside the well through the tubing conductors to selectively connect and disconnect the assembly from the connector mechanism. Operating the salve and sensors from outside the well when the assembly is installed. The assembly tubing is preferably made of a non-conductive, and preferably composite material that enclosed at least one, and preferably a plurality of electrical conductors.

26 Claims, 9 Drawing Sheets

DEEP-SET SUBSURFACE SAFETY VALVE ASSEMBLY

CROSS-REFERENCE TO RELATED APPLICATIONS

Not applicable

STATEMENT REGARDING FEDERALLY SPONSORED RESEARCH OR DEVELOPMENT

Not applicable

REFERENCE TO MICROFICHE APPENDIX

Not applicable

TECHNICAL FIELD

The present invention relates to petroleum-well downhole completion, and more specifically to a system and method providing a deep-set electrically controlled subsurface safety valve assembly.

DESCRIPTION OF RELATED ART

Once an oil or gas well has been drilled to total depth, and occasionally while drilling is still in progress, production of any hydrocarbons present in commercially available quantities can begin. Production is normally accomplished through a conduit, frequently referred to as production tubing, which is significantly smaller in diameter than the hole that has been bored into the earth. This allows for production at a satisfactory rate while also permitting installation of various types of ancillary equipment inside the wellbore. For example, the wellbore itself may be six to sixteen inches in diameter at the surface (where the well penetrates the earth), typically becoming incrementally smaller at various depths, while the production tubing may have a diameter of no more than one to ten inches. The wellbore is typically lined with a metal casing cemented in place to preserve the integrity of the drilled hole. The casing may extend from the surface to the top of the production zone (i.e., hydrocarbon-bearing geologic formation), but more usually reaches all the way to the bottom of the well. In this latter instance, the casing must be perforated to allow the oil or gas to flow into the wellbore.

At the surface, a casing head flange is typically fixed to the top of the casing. To this casing head is then affixed a wellhead assembly, sometimes called a 'Christmas tree', through which access to the well is controlled. The production tubing runs from the production zone to a control valve on the wellhead, which in turn connects to outlet piping that will carry the oil or gas to an on-site storage facility to await removal. In the case of an offshore well, the submerged wellhead may be little more than a than a flange or other device that seals off the casing just above the mudline (top layer of the ocean floor) or in a submerged completion may constitute the entirety of the well head including the 'Christmas tree' and other wellhead production and completion equipment and controllers. In non-submerged completion it is typical for a conduit such as a flexible riser to be used to extend from the submerged wellhead portion at the ocean floor to the ocean surface to carry well production fluids to wellhead portions on a platform or barge positioned on the ocean surface. Well surface is used in onshore wells to designate that part of the well at or above the earths surface. In on shore wells the surface refers to that portion located at or above the submerged earth surface. The water or sea surface refers to the water level.

Damage to the wellhead can cause a drastic interruption of normal well production operations. In addition, damage may result in the leakage of hydrocarbons that pollute the surrounding environment and give rise to the danger of fire or explosion. Leakage is particularly undesirable at wells located offshore or in urban areas, where the unintentional escape of oil and gas can have potentially disastrous consequences for the local environment and its inhabitants. To prevent such damage, production wells are fitted with some downhole means of terminating the flow of petroleum products in the event of a loss of wellhead integrity. For example, the well may have a safety valve system for slowing down or shutting off the flow of petroleum products through the production tubing. In the event that the wellhead control valve is damaged, for example, an abnormally rapid flow rate through the safety valve will be detected, signaling a potential leakage problem and triggering safety-valve closure. Safety valves located below the wellhead are called subsurface safety valves.

A tubing retrievable safety valve (TRSV) is a tubing retrievable safety valve used for controlling production-tubing flow in the event of an emergency, or as required by a particular maintenance event. A TRSV is set and retrieved with the well tubing and is connected to control flow through the well tubing. TRSV's are often positioned at subsurface depths of one to two thousand feet even in wells where the production zone is much lower. This sets the point of flow control well below the earth surface. When removable and reinstallation is required to service the TRSV the tubing length and type is a major factor in maintenance costs.

The TRSV may be hydraulically or electrically operated. In either case, TRSV's are normally spring- or flow-biased so that a loss of valve control results in a closed, rather than open TRSV. In the case of a hydraulically operated TRSV, hydraulic fluid lines are run from the surface wellhead to provide the hydraulic pressure to keep the valve open. Maintaining a constant hydrostatic pressure over such a long run under adverse conditions can be problematic. Even under ideal conditions, the biasing device on the valve must be able to counter the head created by well over a thousand feet of hydraulic fluid filling the control-fluid lines from the surface. In offshore wells, the water depth adds to the length of control lines and in deep water wells can be significant. This may require the use of a more heavy-duty valve than is otherwise required.

Conventional electrically operated TRSV's are powered by either downhole batteries or through 'umbilical' electric lines from a source on the surface. Batteries, however, run down over time and must be replaced, adding to the well-maintenance costs. Although an umbilical does not have this disadvantage, it is subject to damage caused by other well equipment as it is moved in and out of the well.

Tubing length and type are even more important factors in the well costs associated with servicing subsurface safety valves in offshore wells.

Needed is a downhole safety valve assembly and method of use that is efficient, reliable, and economic to service and reduces the frequency of required maintenance. The present invention is directed to just such an assembly and method.

SUMMARY OF THE INVENTION

The present invention is directed to a assembly and method of providing an electrically operated downhole safety valve for use in production petroleum wells and similar operations. In one aspect, the system includes electrically operable in-line safety valve and tubing latch connected to a conduit or tubing of non-conductive material that incorporates a plurality of integral electrical conductors.

In another aspect, the invention is system and method of operating a downhole safety valve including the steps of providing a non-conductive conduit that houses electrical conductors, connecting the conductors to an electrically operated safety valve, connecting the conductors to surface mounted controller and power supply means, and operating the safety valve by variably providing power to the valve from the power supply. The method may also include the steps of monitoring the valve status, and providing an alarm for indicating a loss of power to the valve.

In another aspect, the invention also contemplates the use of an electrically operable tubing latch mounted on a tubing with embedded conductors, connecting the conductors to a power supply and operating the latch (locking and releasing) by variably supplying power to the latch. The invention also contemplates the steps of monitoring the status of the latch and incorporating the latch and safety valve in a single assembly.

In a further aspect the tubing with embedded conductors used in the safety valve and latch assemblies is of the type that is substantially continuous and can be lowered and raised from the well using a spooling device located at the surface without requiring that the tubing be separated into short sections.

BRIEF DESCRIPTION OF THE DRAWINGS

The invention will be better understood and its numerous objects and advantages will become more apparent to those skilled in the art by reference to the following drawings, in conjunction with the accompanying specification, in which.

DETAILED DESCRIPTION OF A PREFERRED EMBODIMENT

Figure 1:
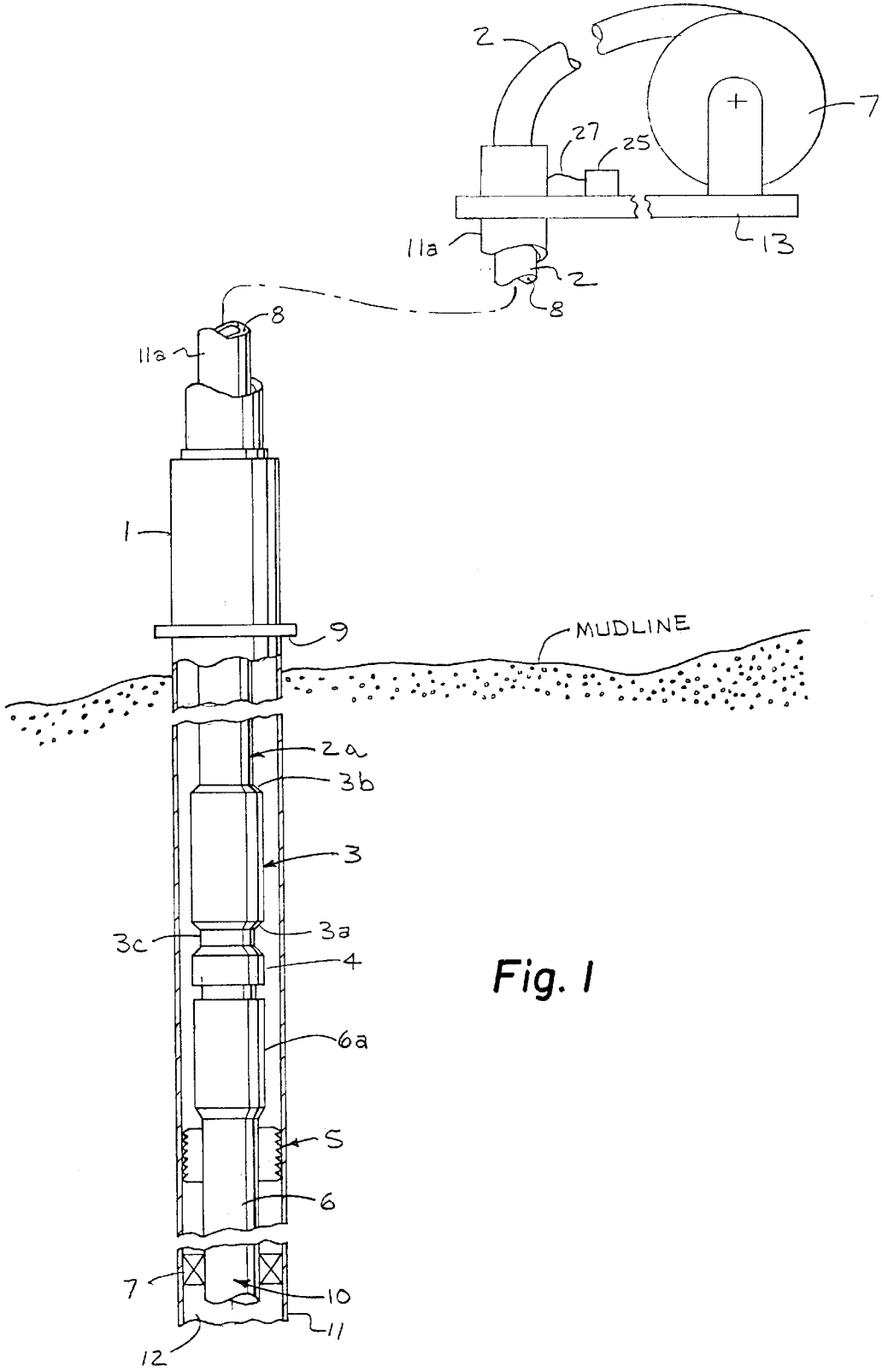
FIG. 1 a simplified longitudinal schematic drawing of an embodiment of the safety valve assembly of the present invention applied to an offshore well environment.

Referring now the drawings where like or corresponding reference characters are utilized through out the several views to refer to like are corresponding parts there is illustrated in FIG. 1 a simplified longitudinal schematic drawing of an embodiment of the safety valve and tubing latch assembly of the present invention shown in an offshore well environment. Offshore, is use herein to refer to wells drilled in a surface covered by water. Depicted in FIG. 1 is the uphole portion of a typical offshore well for producing hydrocarbons. The wellbore is identified by reference numeral 12 and is the cylindrical hole drilled in the formation and generally ranges from six to sixteen inches in diameter. Wellbore 12 is typically larger toward the mudline of the ocean floor, getting narrower in stages as it progresses downward. Wellbore 12 may be less than 1000 feet in depth, or well over 10,000 feet. Wellbore 12 is lined with casing 11, which is generally made of steel or a similar material. When the well is complete, the casing 11 extends the entire length of wellbore 12, but is made up of several sections that are installed one at a time as the well is being drilled. In off shore environments a conductor 11*a* commonly extends from casing head 9 to a platform 13 located above the water surface. Since the upper sections of casing 11 are installed first the lower sections are successively smaller in diameter so they can be installed through the above sections that are already in place. Casing 11 is cemented in the wellbore 12 to prevent the escape of fluids and unwanted movement of the casing.

Once the wellbore 12 is drilled to total depth and the casing is installed, the portion of the casing running through the production zone (not shown) can be perforated or otherwise treated to assist hydrocarbons to flow into the wellbore 12. Perforating is typically performed by lowering a device that uses explosive charges to fire holes through the wall of casing 11. When the well has been completed, production tubing string 10 is installed in the wellbore 12. The tubing extends through production packer 7, which is a device, generally expanded, that is used to seal the annular space between the production tubing string 10 and the inner wall of casing 11. Packer 7 therefore ensures that the well's production is removed only through the production tubing string 10.

Note that FIG. 1 (which is not drawn to scale) depicts the platform 13, casing head 9 and only the upper portion of the wellbore 12, but does not show its termination at or just beyond the production zone. The portion shown is below the mudline (ocean floor) and the portion of wellbore 12 where the safety valve assembly is located.

Just above the mudline, casing head 9 is attached to casing 11, forming a flange for the attachment of completion equipment. This equipment, depicted generally in FIG. 1, consists largely of the wellhead 1, through which all connections to the platform 13 are made. Wellhead 1, for example, includes a connection to conductor 11*a* extending to the platform 13, through which hydrocarbons produced from the well flow. Control and safety valves (not shown) at the platform 13 and wellhead 1 can be used to adjust or to shut off the flow from the well. Wellhead 1 is also connected to the down hole production tubing string assembly 10, through which flows the hydrocarbons being removed from the production zone (not shown).

In accordance with a preferred embodiment of the present invention, a surface production tubing string assembly 2 is provided to extend form the platform 13 to the wellhead 1. As will be described in detail the surface production tubing string assembly includes an electrically operated tubing retrievable safety valve assembly (TRSV) 3 and an electrically operable tubing latch assembly 4. For purposes of description, the upstream side or inlet of the TRSV will be designated by reference numeral 3*a* and a downstream side, or outlet will be designated by 3*b*. An exemplary electrically operable TRSV 3 is shown described in more detail in reference to FIGS. 3A–D. Connected at the inlet 3*b* is a TRSV inlet tubing section 3*c* that can be made out of any desirable material. In the illustrated embodiment, inlet tubing section 3*c* includes embedded electrical conductors and is connected to tubing latch assembly 4. Downhole tubing section 6 includes an expanded coupling portion 6*a* (that may be integrally formed with the downhole tubing section 6, or may be a separate component) supported by hanger 5. Expanded coupling portion 6*a* is preferably connected to TRSV inlet tubing section 3*c* using and electrically operable tubing latch assembly 4 that mates and seals with the coupling portion 6*a*. The operation of this tubing latch assembly 4 will be described by reference to FIGS. 5A–5E. Preferably, as will be described in detail the electric tubing latch 4 can be remotely operated so that this connection can be broken and re-established in the wellbore 12 so that upper production tubing string assembly 2 and TRSV 3 can be detached and removed for maintenance without the need to remove the entire production tubing string assembly 10. In an alternate embodiment (not shown) the safety valve has serviceable parts that can be removed and brought to the surface through the tubing itself for repair or replacement. New or refurbished parts are then reinstalled in like fashion. In this embodiment, the safety valve is provided with a housing that encloses the removable parts, and joins the upper and lower sections of the production string, which therefore can remain in place while this maintenance is performed.

As will be apparent to one skilled in the art, providing hanger 5 as illustrated in FIG. 1 permits the downhole tubing portion 6 of the production tubing string assembly 10 to be supported from casing 11. Preferably, hanger 5 is set with or in addition to a production packer 7. Note that the arrangement of the hanger and packer of FIG. 1 is intended to be exemplary and not limiting. As used in reference to the present invention, a hanger is any device for transferring some or all of the weight of a pipe, tubing string, or other downhole component to the casing. A packer is any device that can be used to partially or completely seal off one portion of the wellbore from another portion, and may accomplish this purpose while allowing a pipe, tubing string, or other downhole component to extend through it. For example, a production packer seals off the annulus surrounding a production tubing string so that fluids may pass only through the tubing (and not through the annulus). The hanger and the packer may be separate devices, or may be one device that serves both functions.

Composite tubing section 2*a* of production tubing string assembly 2 is connected to the outlet 3*b* of TRSV 3, and extends to the platform 13 for conveying fluids that are permitted to pass through TRSV 3. More importantly, composite tubing section 2*a* includes at least one and preferably a plurality of embedded electrical connectors (not shown in FIG. 1). These electrical conductors may be embedded or enclosed in composite tubing section 2*a* in a variety of ways (see FIGS. 4A–D), but are preferably insulated completely from the environment, except at the various necessary terminal connection points. Note that as used herein, the terms "embedded" and "enclosed" with reference to the conductors in the tubing are equivalent, notwithstanding that the details of specifically how the conductors are incorporated in the tubing may impact other characteristics, such as tensile strength or bending radius. Preferably, the number of conductors 8 present is sufficient to provide for the power to operate TRSV 3 and tubing latch 4 and to operate as a monitoring system in controller 25. The operating power is drawn from a power supply (not shown) in surface controller 25 through power conductors 8 in embedded tubing section 2 to the TRSV 3 and tubing latch 4. Conductors 8 may also include one or more control conductors (not shown) for the purpose of sending control signals to and receiving status signals from TRSV 3 and tubing latch 4 and any downhole transducers.

Note that composite tubing section 2 may actually be made up of a plurality of interconnected sections, although one continuous section is preferred because it avoids problems associated with leaking connections or having to ensure proper electrical contact numerous times between the wellhead 1 and the TRSV 3. Moreover, composite tubing is generally spoolable, meaning that the one continuous section can be wound on a spool or reel 7 as it is removed, making trips in and out easier and quicker. On the other hand, it is likely that steel tubing section 6 comprises a plurality of interconnected sections, although in accordance with the present invention it is not so required and could also be composite tubing.

In accordance with the present invention, a safety valve assembly can be installed and removed quickly and efficiently using the configuration illustrated in FIG. 1. After the well has been drilled, cased and completed production tubing string assembly 10 is installed in a conventional manner with the expanded coupling portion 6*a* on its uphole end. The tubing assembly with the electrically operable valve 3 and tubing latch 4 connected to the conductors 8 in tubing section 2*a* is unspooled from reel 7 on platform 13 and lowered into the conductor 11*a* through the casing head 9 and to the mating expanded coupling portion 6*a*. Although not shown the assembly could also use conductors 8 to transmit signals relating to subsurface: 1. sensors for valve and latch position; 2. transducers monitoring well conditions such as flow rate, temperature and pressure; and 3. other remotely actuateable devices such as injectors and the like. The electrical tubing latch 4 latches the tubing into sealed engagement with the expanded coupling portion 6*a*. Conductors 8 connected to the various subsurface devices, sensors and transducers are wired at 27 to the control box 25 containing suitable related circuitry well known in the art. Thereafter the normally closed TRSV 3 is held open by electrical power supplied to the valve from controller 25 through conductors 8. When power is removed the valve closes. Control of the valve could be in response to information relating to subsurface well conditions transmitted through conductors 8. To remove the assembly, power is supplied through conductors 8 to operate or open latch 4 allowing the assembly to be removed on to reel 7 located on the platform 13. In land installations the operation would be identical.

Figure 2:
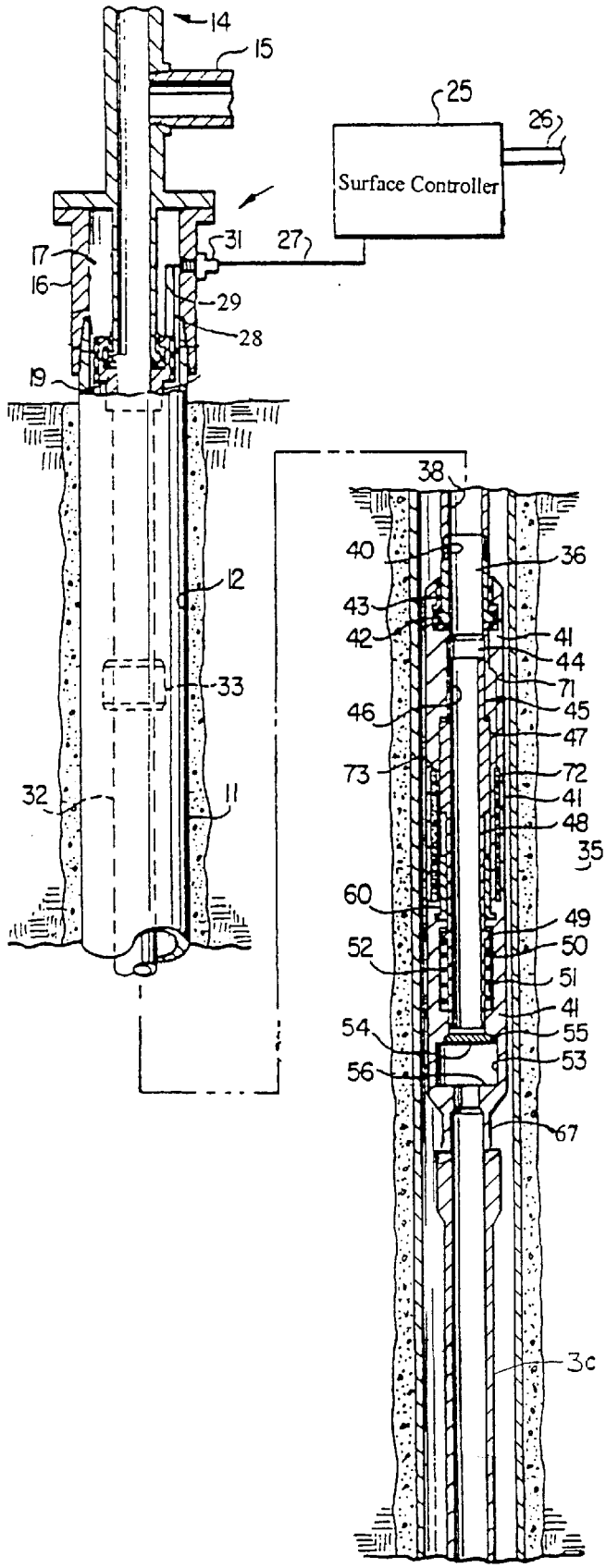
FIG. 2 is a detailed schematic drawing of an onshore well completion including a partial cross-section view of an embodiment of the valve assembly of the present invention.

FIG. 2 is a detailed schematic drawing of a land based well completion including a partial cross-section view of an embodiment of the valve assembly of the present invention. This figure would also be exemplary of a offshore well with a submerged completion. Casing 11 is positioned as a liner for previously drilled wellbore 12. Casing 11 extends from a wellhead 1, located at the surface, downward to a producing geological formation, or 'production zone'. Note that as used herein, "down", "downward", or "downhole" refer to the direction from the wellhead toward the producing zone regardless of whether the wellbore proceeds straight and directly downward from the surface. "Surface" refers either to the ground level or to the ocean floor, as applicable. Here, wellhead 1 includes production flow control assembly (Christmas tree) 14, which has a production output line 15 leading to storage facilities (not shown) for receiving production flow from the well. Wellhead 1 also includes wellhead support flange, or casing head 16, which is connected to casing 11. This connection is shown in FIG. 2 as a threaded connection, but alternately may be a welded connection as well. Connected to output line 15 is wellhead production conduit 17, which is integrally formed in the production flow control assembly 14 and extends downward through casing head 16 to engage tubing head 19. Upper production conduit 32 connects with wellhead production conduit 17 at tubing head 19 and extends downward into wellbore 12.

In accordance with the present invention, upper production conduit 32 comprises tubing formed of a non-conducting material, and is preferably a composite tube having a plurality of layers. Embedded or enclosed within the non-conducting material is a plurality of electrical conductors 8 (not shown). The construction of the non-conductive tubing is described in more detail below. In the illustrated embodiment, wellhead surface controller 25 is connected to a source of electric current (not shown) by means of power cable 26. In a preferred embodiment multi conductor cables 27 and 28 connect the surface controller 25 to the embedded electrical conductors 8 in upper production conduit 32. In an alternate embodiment, an optional condition status-monitoring circuits (not shown) and transducer circuits are also carried by the embedded conductors. In yet another embodiment, a single embedded conductor serves as the positive conductor of the power circuit, with casing 11 serving as a connection to ground.

At the lower end of upper production conduit 32, there is positioned a TRSV 35, preferably a solenoid-actuated valve, such as the one described in more detail in U.S. Pat. No. 4,981,173, entitled Electric Surface Controlled Subsurface Valve System, which is by reference incorporated here in its entirety for all purposes. Set forth below is a description of one such valve adapted for use according to an embodiment of the present invention. TRSV 35 is mechanically and electrically coupled to the conduit 32 by means of an assembly support flange 36 that engages the end of conduit 32. The TRSV 35 includes an elongate housing 41 having a generally cylindrical outer configuration and recesses formed therein for receiving the components of the solenoid-actuated safety valve. The assembly support flange 36 includes a threaded tubular upper end 40 and a lower end having a radially extending flange portion 42 attached to the inner walls of the housing 41 by means of an adaptor 43. Housing 41 includes an axially extending central bore 44 for receiving an operator tube 45 adapted for axial movement therein. The operator tube 45 may preferably be formed of several cylindrical sections of varying thickness and mass as well as of materials having different magnetic permeability.

At the upper end of the operator tube 45 there is a relatively thin walled upper section 46 formed of a relatively less magnetic material, such as 9CR-1MOLY steel. An intermediate armature portion 47 is constructed of a highly magnetic material such as 1018 low carbon alloy steel and forms a central portion of operator tube 45 while an elongate thin-walled lower section 48 is formed of less-magnetic material. The bottom section of the operator tube 45 is also of relatively-less magnetic material and includes a radially extending circumferential flange member 49 that is received within a radially extending cavity 51 formed in the inner walls of the housing 41. A helical spring 52 surrounds the lower section 48 of the operator tube 45 and normally biases the tube in the upward direction by a force exerted against the circumferential flange 49.

A lower cavity 53 in the housing 41 receives a valve flapper member 54 that is pivotally mounted to the sidewall of the housing 41 by a hinge 55 that is spring biased toward the closed position, as shown. A sufficient force against the upper side of the valve flapper 54 will cause it to pivot about the hinge 55 and move into the side walls of the cavity 53 thereby opening the interior axial passageway 44 through the housing 41 to allow the flow of borehole fluids lower down in the borehole up through upper production conduit 32 to wellhead 1.

The lower end of housing 41 is electrically and mechanically connected to inlet tubing 3*c* (see FIG. 1) which in turn is connected to tubing latch 4. It is envisioned that the electrical tubing latch could be replaced with a mechanical or hydraulically operated latch-seal assembly to connect the TRSV assembly to the production tubing string.

Solenoid coil 72 is positioned within the body of the housing 41 so that the highly magnetic armature portion 47 of the operator tube 45 is located near the upper ends of the solenoid coil 72 when there is no current flow through the coil and the tube 45 is in its upwardly-spring-biased position. A cylindrical magnetic stop 60 is positioned within the central bore 44 near the lower end of the solenoid coil 72 so that the lower portion 48 of the operator tube is axially movable therethrough. A mechanical stop 56 is formed on the lower inside edges of the cavity 53 to limit the extent of the downward movement by the operator tube 45. When the lower edge of bottom section 50 of the operator tube 45 abuts the mechanical stop 56, the lower edge of the armature portion 47 is spaced by a small but distinct air gap from the upper edges of the magnetic stop 60. The highly magnetic stop 60 creates a low reluctance path for magnetic flux generated by the solenoid coil 72 so that the armature 47 of the operator tube can be held adjacent thereto by a relatively low value of current flow through the coil 72. The air gap, for example on the order of 0.050 inch, is provided to insure that the operator tube 45 will return to its upper position in response to the force generated by the bias spring 52 when current is removed from the coil 72 and will not be retained in the lower position by residual magnetism due to physical contact between the operator tube and the magnetic stop 60. When an actuation current of a first value flows through the winding of the solenoid coil 72 the magnetic flux generated thereby causes the armature 47 to move downwardly toward the center of the coil 72.

As the lower edges of the operator tube 45 move downwardly toward mechanical stop 56, they cause the spring-bias flapper 54 to pivot about hinge 56 into the cavity 53 to open the safety valve and allow production fluids to flow up the tubing to the wellhead 1. When the operator tube 45 moves to its lower actuated position, the helical spring 52 is compressed by the circumferential flange 49. Once the armature 47 has been moved to the lower position by a relatively high value of magnetic flux produced by a relatively high value of actuation current through the solenoid coil 72, the lower edge of the armature 47 is closely spaced from the magnetic stop 60. Thereafter, a relatively lower value of magnetic flux generated by a relatively lower value of holding current through the coil 72 will retain the operator tube 45 in its lower actuated position and the valve flapper 54 in the open condition. Removal of all current from the coil 72 allows the spring 52 to move the operator tube 45 to its upper position, which allows the spring-biased hinge 56 to close the flapper 54 and thus the safety valve to the flow of any borehole fluids up the tubing 32 to the wellhead 1.

The power to actuate and hold open the safety valve comes from the surface controller 25, through cable 27 where it connects at the wellhead 1 with the electrical conductors 8 embedded in the otherwise non-conductive tubing 32. As previously mentioned, the tubing 32 is preferably continuous, but may alternately comprise any number of sections as long as the appropriate electrical connections between the conductors of each section are made.

Figure 3A:
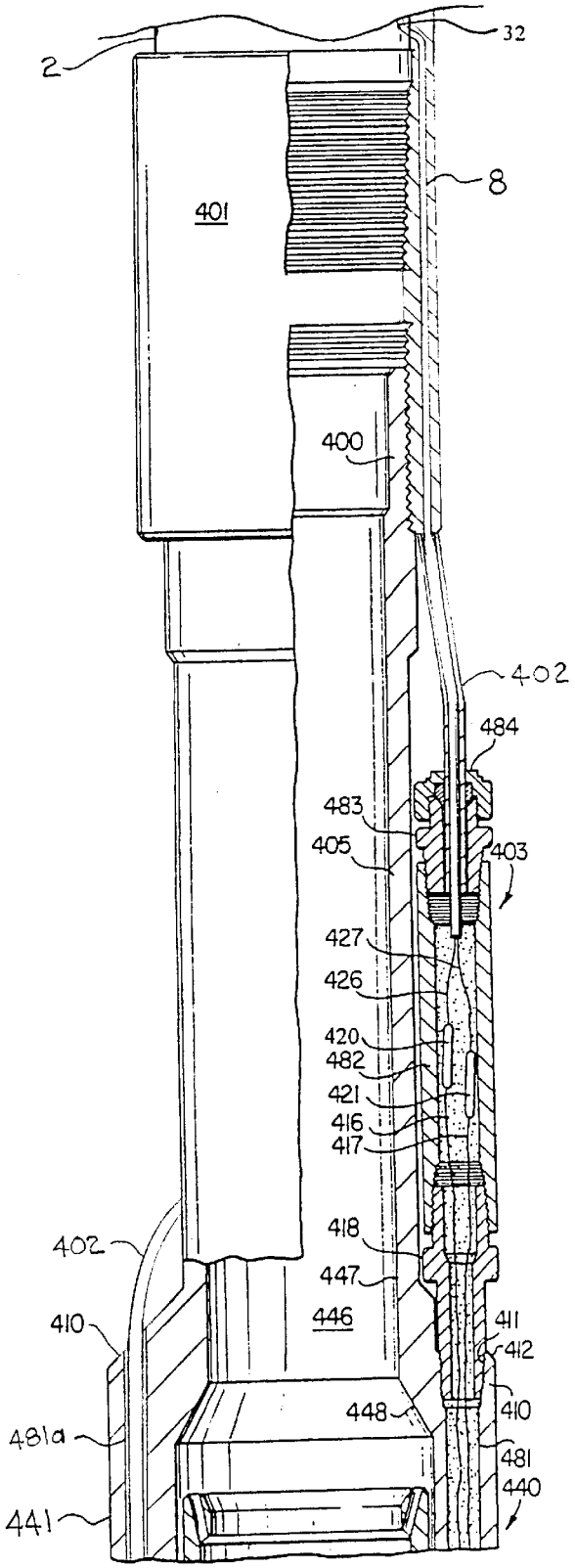
FIGS. 3A–D are detailed longitudinal cross-section drawings of a tubing retrieval safety valve according to an embodiment of the present invention.

Reference is now made to FIGS. 3A–D, which are detailed longitudinal cross-section drawings of a TRSV according to an embodiment of the present invention. The body of valve assembly 440 includes an upper housing 441, a lower housing 442, and a bottom sub 443. Referring first to FIG. 3A, the upper end of the assembly 440 includes a threaded portion 400 for coupling to the lower end of upper production conduit 32, which extends from the wellhead 1. In this embodiment a threaded electrical coupling 401 forms a threaded connection between the portion 400 and tubing 32. The conductors 8 in tubing 32 are connected to a multiple conductor cable 402 in coupling 401. Cable 402 provides the electrical connection to the TRSV and any other electrical components or sensors. The upper housing 441 is threaded to the lower housing section 442. The walls of the upper and lower housing sections 441 and 442 and the bottom sub 443 are relatively thick and for the load bearing members of the assembly 440 and may illustratively formed of a conventional relatively less magnetic steel material such as 9CR-1MOLY. The upper housing 441 of the TRSV assembly 440 of connected to the threaded portion 400 by mean of a reduced neck section 405. The lower end of the neck section 405 includes an outwardly flaring shoulder region 410 into which extends an axial bores 481 and 481*a*, the open ends of which extend through the conical face 412 of the shoulder region 410 and can includes threads 411. The upper housing section 441 of the TRSV assembly 440 is threadedly connected to lower section 442 by means of mating threads 444. Similarly, the lower end of the lower housing section 442 is threadedly coupled to the bottom sub section 443 by means of a threaded coupling 445 (shown in FIG. 3D).

Figure 3B:
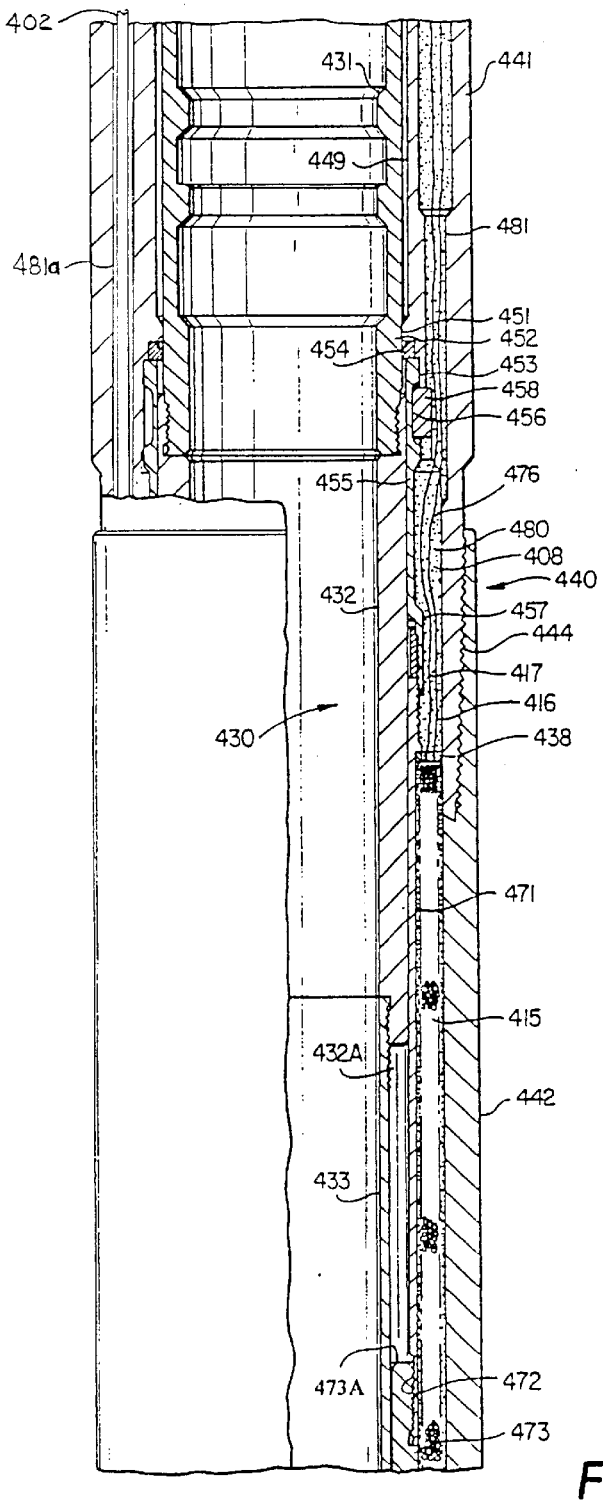
Figure 3C:
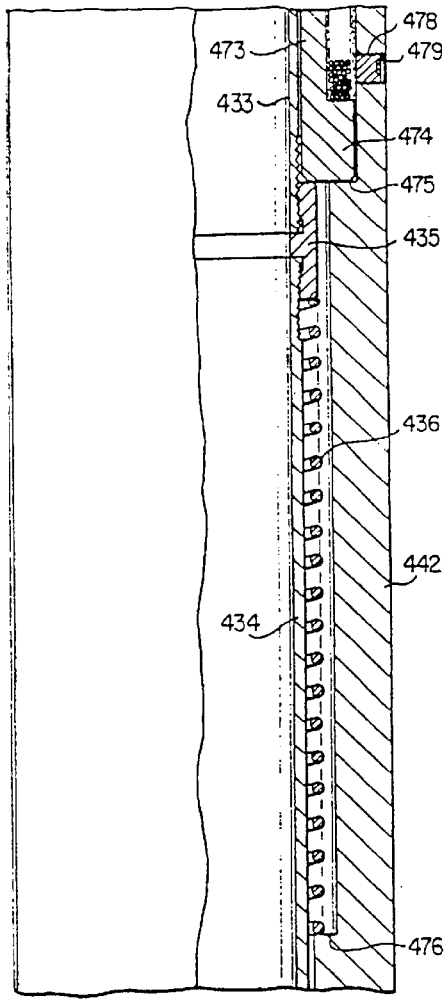

The interior of assembly 440 includes an axially extending fluid conduit 446, the upper end of which is defined by a cylindrical inner wall 447 within the neck section 405 and which flares radially outward at conical transition region 448 and, turning to FIGS. 3B–C, extends downwardly as a cylindrical wall 449 having an inwardly extending ridge 451 located near the lower edge thereof. The lower edge of the inner wall 449 beneath the ridge 451 includes a first radially outward extending region 452 a second radially outward extending stepped region 453. The first stepped region 452 receives a low friction rectangular scraper ring 454 for excluding sand and trash from the housing internal diameters and the moving tubular valve armature. The second stepped region 453 receives the upper end of an anti-rotation adjustment tube 455, which allows for threaded adjustment of the length of the solenoid coil assembly and tubes so that there is a snug fit when the upper and lower housings 441 and 442 are screwed together regardless of tolerance build up in the parts. The outer surface of the anti-rotation adjustment tube 455 is generally cylindrical with a circular upper recess 456 and a radially outward flared lower foot portion 457 having adjustment threads formed on the inner surface thereof. Received within a radially inward extending upper recess 456 formed in the outer wall of adjustment tube 455 is a steel pin 458 used to prevent rotation of the solenoid coil relative to the upper housing 441 and to thereby eliminate twisting and cutting of the solenoid coil wires.

The interior of the lower housing section 442 receives a cylindrical coil tube 471 having external threads on the upper end thereof which engage the internal threads on the foot portion 457 of the anti-rotation adjustment bearing tube 455. The coil tube 471 is a thin-walled non-load-bearing tube formed of a nonmagnetic stainless steel around which the solenoid coil 415 is wound. The coil tube 471 extends downwardly and includes an internally threaded section 472 which engages the externally threaded section of a relatively thick cylindrical magnetic stop 473. The lower end of the magnetic stop 473 includes a radially outward extending flange region 474, which engages the radially outward extending stepped region 475 formed in the inner wall of the lower housing 442. The cylindrical magnetic stop 473 provides a magnetic stop for the armature 432 of the operator tube 430. When the lower edge of the armature 432 is positioned close to the stop 473, the magnetic attraction between them is very high for a given value of solenoid current. Both the magnetic stop 473 and the armature 432 are made of a soft magnetic material having a low value of residual magnetism. The stepped region 475 extends radially inward approximately one-half the thickness of that section of the wall of the lower housing 442. A second radially extending stepped region 476 is positioned near the lower end of the lower housing section 442 and receives the lower end of a helical spring 436, which is used to bias the operator tube 430 in the upward direction.

Figure 3D:
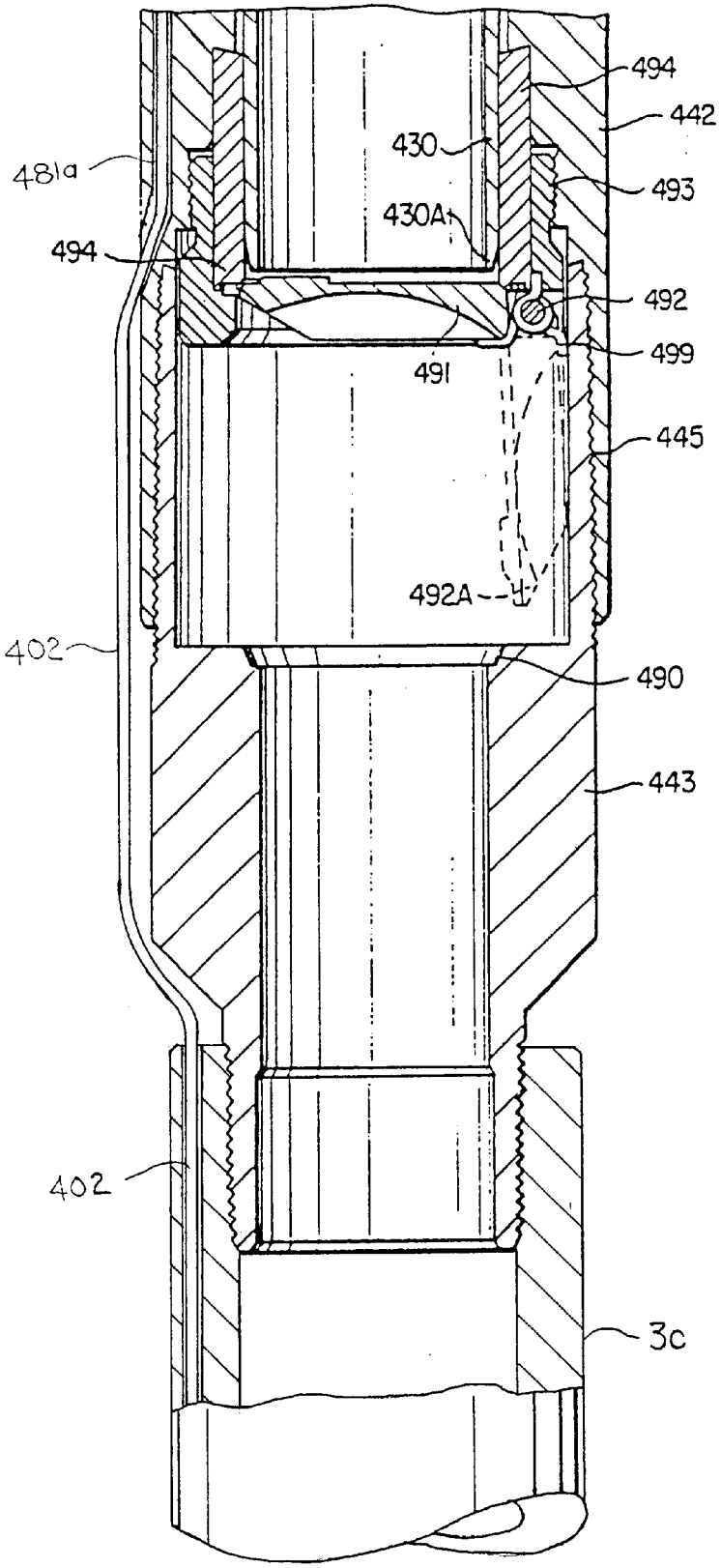

As can be seen in FIG. 3D, the lower end of the lower housing section 442 mounts a TRSV flapper 491, which is pivotally connected by means of a hinge 492 to flapper housing assembly 493, which in turn is received into the lower housing assembly 442. The TRSV flapper 491 pivots about the hinge 492 to the position shown in phantom at 492A to open the flow through the valve in response to actuation of the solenoid coil 415. The hinge 492 also includes a spring 499 that normally biases the flapper 491 into the closed position against the valve seat insert 494. Movement of the operating tube 430 of the solenoid, which will be further described below, in a downward direction, toward the mechanical stop 490, causes the flapper 491 to pivot about the hinge 492 into the phantom position 492A and allow fluids to flow upwardly into the lower end of the assembly 440, through the axial passageway 446 and upwardly through the valve assembly and the upper production conduit 32 toward wellhead 1.

Referring again to FIGS. 3A and 3B, the upper housing section 441 includes a cylindrical annular region 476 formed between the inner well surface of the upper housing section 441 and the outer surface of the anti-rotation adjustment bearing tube 445 and the coil tube 471. This annular region 476 extends down adjacent the inner wall of the upper housing section 441, adjacent thinner wall of the lower housing region 442 and terminates at the upper edge of the stepped region 477 formed by the radially outward extending flange 474 of the magnetic stop 473. A radially extending threaded aperture 478 is formed through the walls of the lower housing section 442 and is closed by means of a threaded insert 479.

A cylindrical solenoid coil 415 is wound from high temperature magnetic wire around a thin cylindrical coil tube 471 and is positioned in the annular cavity 476 formed between the inner wall of the lower housing section 442 and the outer wall of coil tube 471 and magnetic stop 473. The ends of the wires forming the solenoid coil 415 extend as single conductors 416 and 417 upwardly through the annular space 476 and through an elongate cylindrical bore 481, which is formed within the wall of the upper housing section 441 and is connected to the threaded opening 411. The upper end of the electrical coupling extension 403 comprises a plug member 418 having threads on the lower end, which engage the threaded opening 411 in the bore 481.

An upper fitting 483 comprises a thermocouple connector that threadedly engages the upper end of the extension 482 and receives, through a threaded cap member 484, the cable 402 extending from the junction 401 where it connects to the embedded conductors in composite tubing 32. Conductors 426 and 427 contained within the cable 402 are connected to the conductors 416 and 417 by means of splice members 420 and 421. Note that while FIG. 3A shows an exemplary connection between the conductors of the non-conductive tubing string and the TRSV, the connection may be made in a variety of ways in accordance with the present invention. In another embodiment, for example, cable 402 is wholly enclosed within the body of the TRSV. In yet another embodiment, the TRSV is provided with an upper fitting to connect with the upper tubing string both mechanically and electrically. Also as shown in FIGS. 3A–3D, cable 402 branches off and extends through axially extending bore 481*a* and is coupled to the conductors in tubing 3*e*.

A multi-element cylindrical operator tube 430 includes a relatively thin-walled upper segment 431 formed of a relatively less magnetic material such as 9CR-1MOLY steel, which is resistant to the highly corrosive borehole fluid environment. The upper segment 431 is threadedly connected to a cylindrical armature segment 432, which is formed of a highly magnetic material such as 1018 low carbon steel alloy that is also highly corrosion-resistant. A thin wall elongate lower segment 433 is threaded to the lower end of the armature segment 432 and is formed of relatively less magnetic material such as 9CR-1MOLY steel. A similar thin wall elongate lowest segment 434 of the operator tube 430 is threaded to the lower end of the lower section 433 by means of a junction flange 435. The lowest segment 434 is also formed of a relatively less magnetic material. The lower edge of the junction flange 435 abuts the upper end of a helical coil spring 436, the lower end of which abuts the upper surface of the stepped region 470 in the lower housing section 442. The spring 436 serves to spring-bias the entire operator tube 430 into the upward direction holding the upper edge of junction flange 435 against the lower edge of the radially outward extending flange 474 of the magnetic stop 473 in the absence of current through the solenoid coil 415. The operator tube 430 is adapted for longitudinal movement within the axial passageway 446 formed down the center of housing 440.

The operator tube 430 is positioned in the passageway 446 of the housing 440 so that the armature segment 432 extends above the upper end of the solenoid coil 415. The tubular magnetic stop member 473 is located near the lower end of the solenoid coil 415. A mechanical stop 490 is located at the bottom of the passageway 446 in the bottom sub section 443, and below the lower end of the operator tube 430 in its lowermost position, to limit the extent to which the tube 430 can travel in the downward direction. When the operator tube 430 is at its lowest position, the lower edges of the operator tube 430A (shown in FIG. 3D) abut the mechanical stop 490 while the lower edges of the armature segment 432A spaced by a small but definite air gap from the upper edges 473A of the magnetic stop member 473. The magnetic stop 473 is made of a highly magnetic material to form a low reluctance path for magnetic flux generated by solenoid coil 415 when the armature 432 is in the lower position. This allows the armature 432 to he held adjacent to the magnetic stop 473 by a value of current flow through the solenoid 415 much less than that required to initially move the operator tube 430 in the downward direction from its upper rest position. The air gap between the lower edge 432A of the armature 432 and the upper edge 473A of the magnetic stop 473 prevent the pieces from sticking together due to residual magnetism when all the current has been removed from coil 415.

Referring to FIG. 3D, near the lower end of assembly 440, the safety valve flapper 491 is pivotally connected by means of the hinge 492 to the lowest end of the lower housing section 442 and pivots about the hinge 492 to the position shown in phantom at 492A to open the flow through the valve in response to actuation of the solenoid. The hinge 492 also includes a spring 498 that normally biases the flapper 491 into the closed position as shown. Movement of the operator tube 430 in a downward direction toward the mechanical stop 490 causes the flapper 491 to pivot about the hinge 492 into the phantom position 492A and allow fluid flow into the lower end of housing 442, through the TRSV toward the surface.

As can be seen from FIG. 3D, when the operator tube 430 moves downwardly against the force of helical spring 436 in response to magnetic forces produced by current flowing through the windings of the solenoid coil 415, the lower edges 430A press against the flapper door 491 causing the flapper to move about hinge 492 into the open position. Whenever the current flow through solenoid 415 is interrupted, the helical spring 436 again biases the operator tube 430 upwardly, allowing the spring-biased hinge 492 to move the flapper door 491 toward a closed position. Current flow to energize the solenoid 415 comes from the embedded conductors in the composite upper production conduit 32, then through the conductors 426 and 427 contained within the cable 402 and the splices 420 and 421 into conductors 416 and 417 forming the opposite ends of the windings of the solenoid coil 415. From the splice 420 and 421, the conductors 416 and 417 extend downwardly through the cylindrical bore 481, in the sidewall of the upper housing portion 441 and through the annular region 480 to the upper edge of the solenoid coil 415. Again, in an alternate embodiment (not shown), a single conductor may carry the positive electrical charge through cable 402 and conductor 416, with conductor 417 making contact with ground at casing 11, thereby completing the circuit.

The non-conductive upper production conduit 32 that extends from the wellhead 1 to the TRSV 35 may be made of a variety of materials and be constructed in different ways. Its non-conductive nature ensures that the conductors embedded inside will be insulated from each other and from the external environment of the wellbore, meaning that they are useful in applications where the wellbore may be flooded with fluid. In addition, due to the relatively strong materials that can be used in conduit construction, there is only minimal danger of damage from the ordinary insertion or removal of other tools, conduit, or downhole equipment.

Composite tubing is typically of a reinforced resin construction that is not only nonconductive but has generally acceptable load-bearing characteristics and resistance to corrosion. In addition, composite tubing can be manufactured in very long runs and is bendable enough to spool, so that in applications such as the one present invention, a single section may be used. The construction and the benefits of various kinds of composite tubing are described in more detail in U.S. Pat. No. 5,913,337, entitled Spoolable Composite Tubular Member with Energy Conductors, and in U.S. Pat. No. 6,016,845, entitled Composite Spoolable Tube, both of which are by reference incorporated here in their entirety. Exemplary composite tubes or pipes suitable for use in accordance with the present invention are described herein. Composite materials that may be contained in composite outer member include fiber reinforced thermoset resin such as epoxy and vinyl ester or thermoplastic resin such as polyetheretherketone (PEEK), polyetheretherkeytone (PEKK), nylon, etc. The fiber reinforcing can utilize such materials as carbon, aramid, and glass.

Figure 4A:
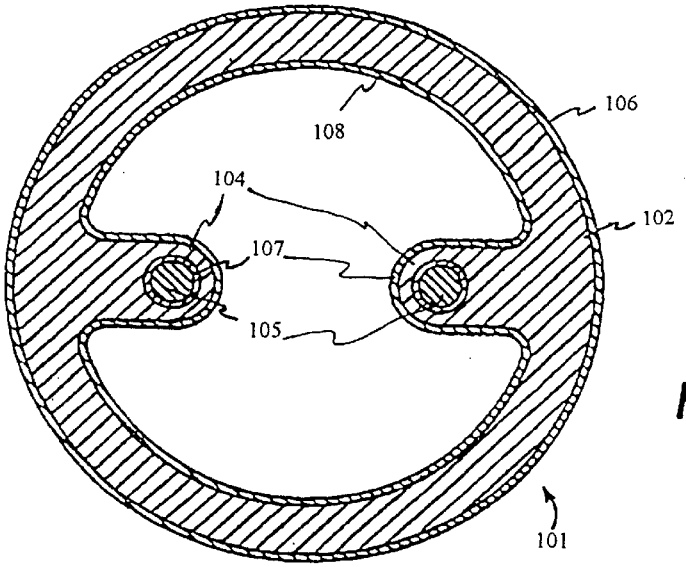
FIGS. 4A–D are cross-sectional views of three exemplary configurations of tubing having embedded electrical conductors, such as may be used in accordance with an embodiment of the present invention.

FIGS. 4A–D are cross-sectional views of four exemplary configurations of composite (and non-conductive) tubing having embedded electrical conductors, such as may be used in accordance with an embodiment of the present invention. In the embodiment of FIG. 4A, composite tubular member 101 includes a composite outer member 102 that may be of a generally cylindrical shape, and two composite inner members 104, that can be made of fiber reinforced materials such as those recited above. If desired, additional friction and corrosion resistance may be obtained through the use of outer tubing covering 106 or inner tubing liner 108 or both. Covering 106 and liner 108 may be made of materials such as polytetrafluoroethylene (PTFE), polyvinyl chloride (PVC) polyethelene (PE), ethylene tetrafluoroethylene (ETFE) polyvinylidene fluoride (PVDF), nylon, polypropyleve (PP), or polyetherether ketone (PEEK). Coextrusions of two or more of these materials or fiber reinforcement may be desirable for certain applications. Conductors 105 may, for example, be copper cables, run throughout the length of composite tubing member 32 and may either be provided with a separate insulating layer 107 (as shown) or may rely on the composite tubing material for insulation. Note that although two conductors 105 are shown, there could be any number as permitted by the size of the tubing member. And although electrical conductors would be required for supplying power to the safety valve, a fiber optic conductor may alternatively be used if applicable for control signal transmission.

Figure 4B:
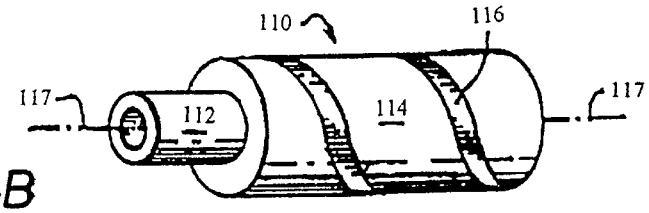

Another composite tube that may be used as an upper conduit between safety valve 35 and wellhead 1 is shown in FIG. 4B, which is a side view, partially broken away, of a composite coiled tube. Referring to FIG. 4B, composite tube 110 includes a liner 112, a composite layer 114, and a conductor 116 forming part of the composite layer 114. In this embodiment, conductor 116 is oriented helically relative to the longitudinal axis 117 of the tube 110 in order to minimize the bending stress on the conductor, for example if the tube is bended or coiled. Although not shown in FIG. 4B, tube 110 may comprise additional layers, and conductor 116 may be formed as part, inside, or placed in between any of the layers, as desired.

Figure 4C:
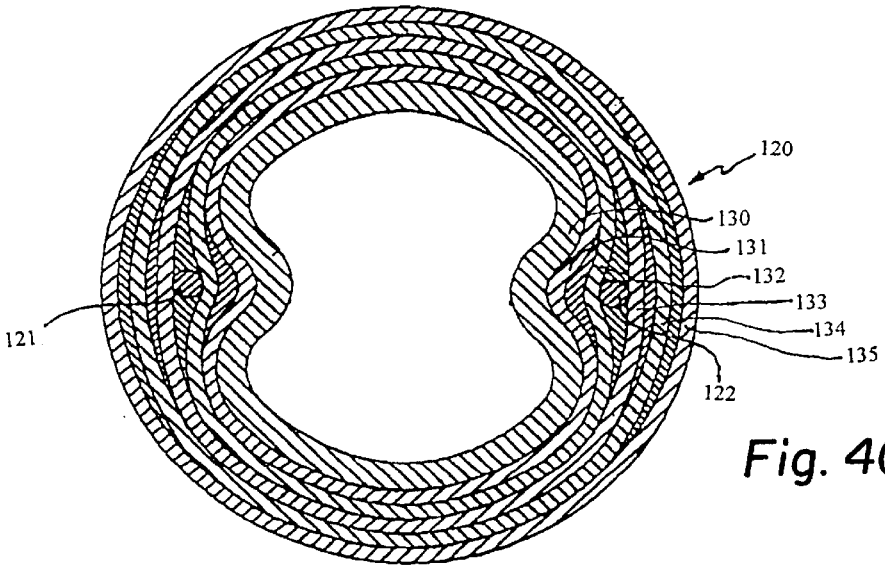

Yet another embodiment is shown in FIG. 4C. Here, the tube 120 has six layers 130–135, with two conductors 121 and 122, both placed between the inner layers 132 and 133 on opposite sides of tube 120. In addition to providing a nonconductive pipe with enclosed conductors according to the present invention, the conductors as placed here in tube 120 of FIG. 4C also provide additional axial stiffness together with greater compressive, axial, and shear strength.

Figure 4D:
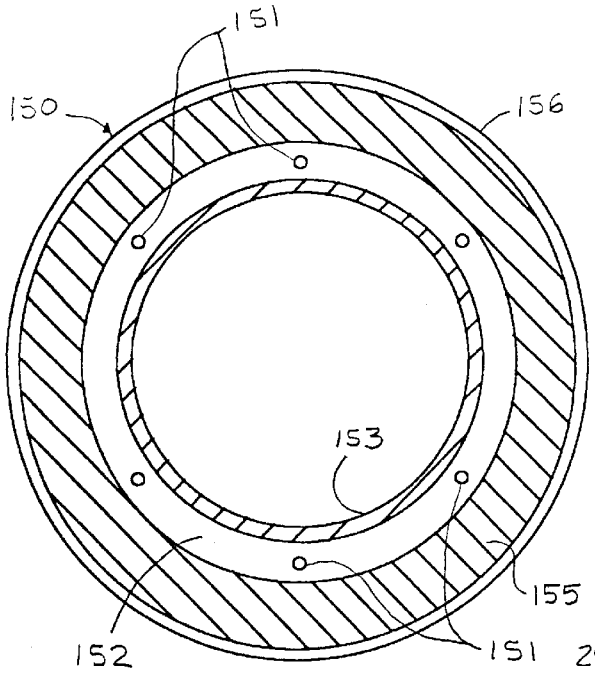

FIG. 4D illustrates a variation of the embodiment of FIG. 4C, in which the composite pipe 150 contains multiple conductors 151 embedded in an insulating layer 152. Inside the insulating layer 152 is a protective sheath 153 of impermeable material. Out side the insulating layer 152 is a primary strength layer 155 surrounded by an outer protective sheath layer 156.

Figure 5E:
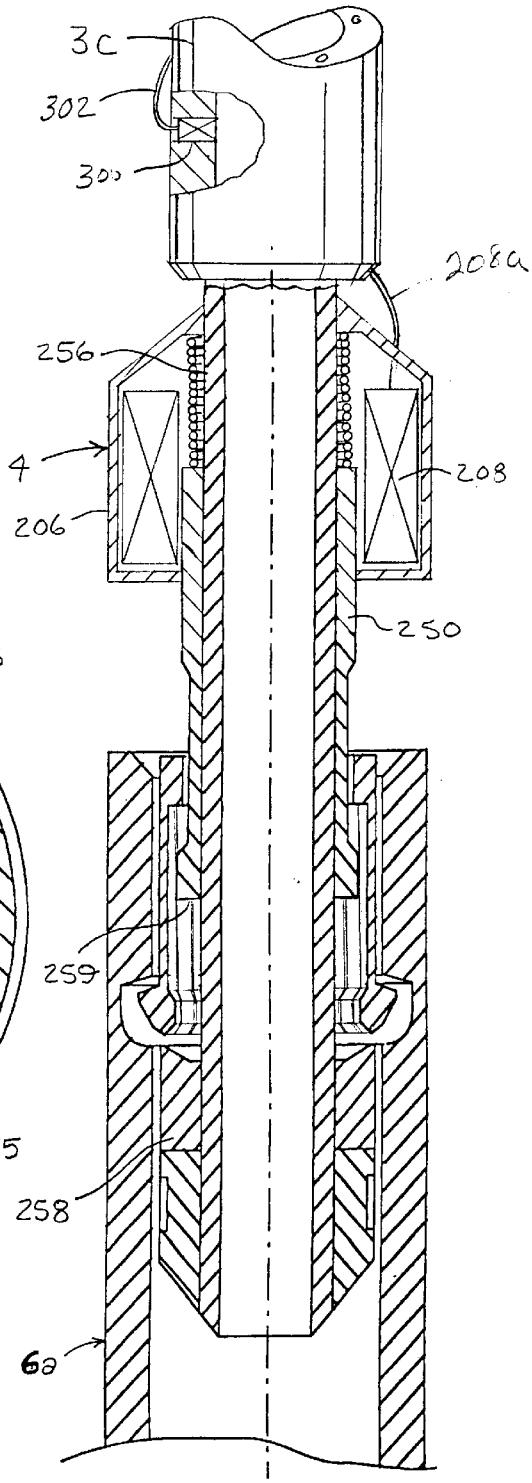
FIGS. 5A–E are cross-section drawings of an electrically actuated tubing latch according to an embodiment of the present invention.
Figure 5A:
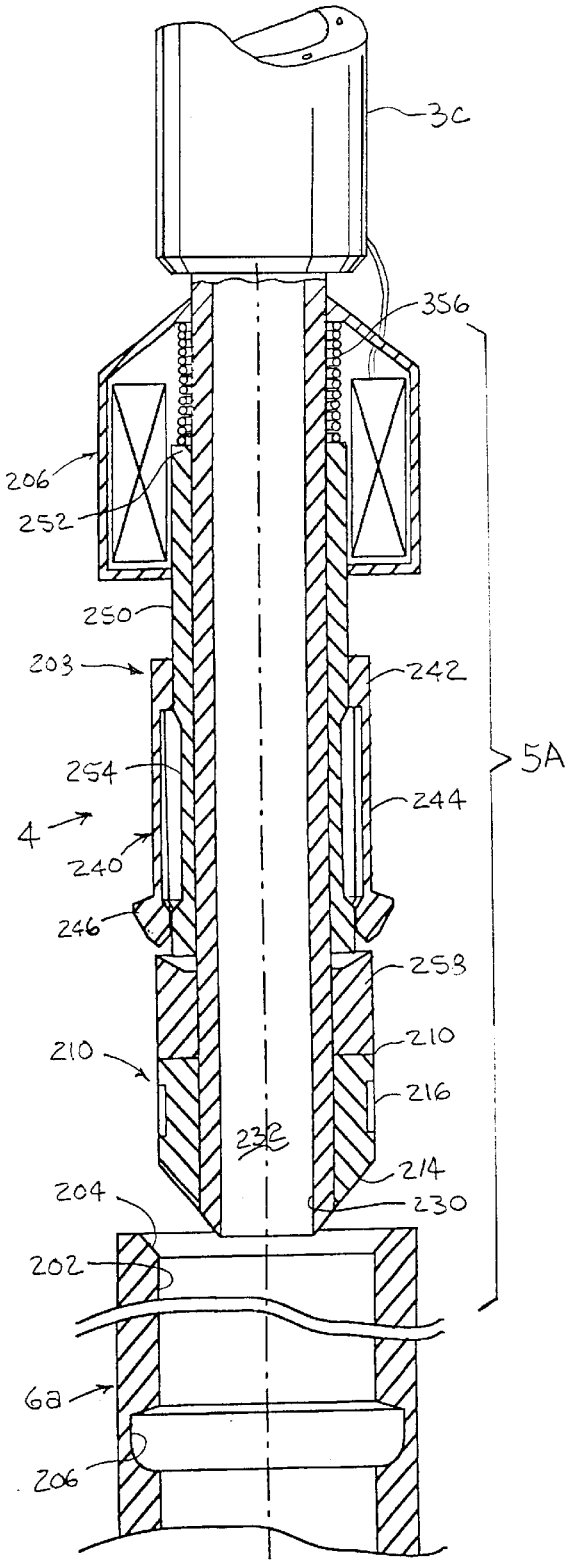

In FIGS. 5A–E the structure and operation of an exemplary electric tubing latch assembly 4 will be generally described. In FIG. 5A the latch 4 is shown adjacent to the expanded coupling portion 6*a*. Portion 6*a* has an axially extending latch receiving bore 202 of a size and shape to function with and receive latch 4 therein. Although not shown the bore can contain packing or other sealing elements to seal with latch 4. In the illustrated embodiment sealing elements are mounted on the latch and cooperate with the wall of bore 202 to form a sealed connection. The uphole-facing end 204 of portion 6*a* is countersunk to assist tool alignment and entry into the bore 202. An annular locking grove 206 is formed in the wall of bore 202 at a location spaced from the end 204. Grove 206 cooperates with a latch 4 to releasably connect tubing 3*c* to portion 6*a*.

Latch assembly 4 can comprise any electrically operated downhole latch. Latch assembly 4 is illustrated as having an upper solenoid portion 206, a central collet portion 208 and a lower stinger 210. Stinger 210 has a cylindrical portion 212 with a tapered nose 214. A suitable seal and groove 216 is formed in the exterior of portion 212. Portion 212 is designed to axially fit in bore 201 with seal 216 sealing therein. Stinger portion 210 is mounted on a mandrel 230 that extends through portions 206 and 208 and is coupled to tubing 3*c*. Mandrel 230 has a central bore 232 in fluid communication with the interior of tubing portion 3*c*. Stinger 210 can be threaded or otherwise attached to mandrel 230.

Collet portion 208 comprises a collet spring assembly 240 and a locking sleeve 250. Spring assembly 240 has a cylindrical body portion 242 mounted to axially slide along locking sleeve 250. A plurality of spring fingers 244 extending axially downward from the body portion 242. Locking tabs 246 are formed on the ends of each of the fingers 244.

Figure 5B:
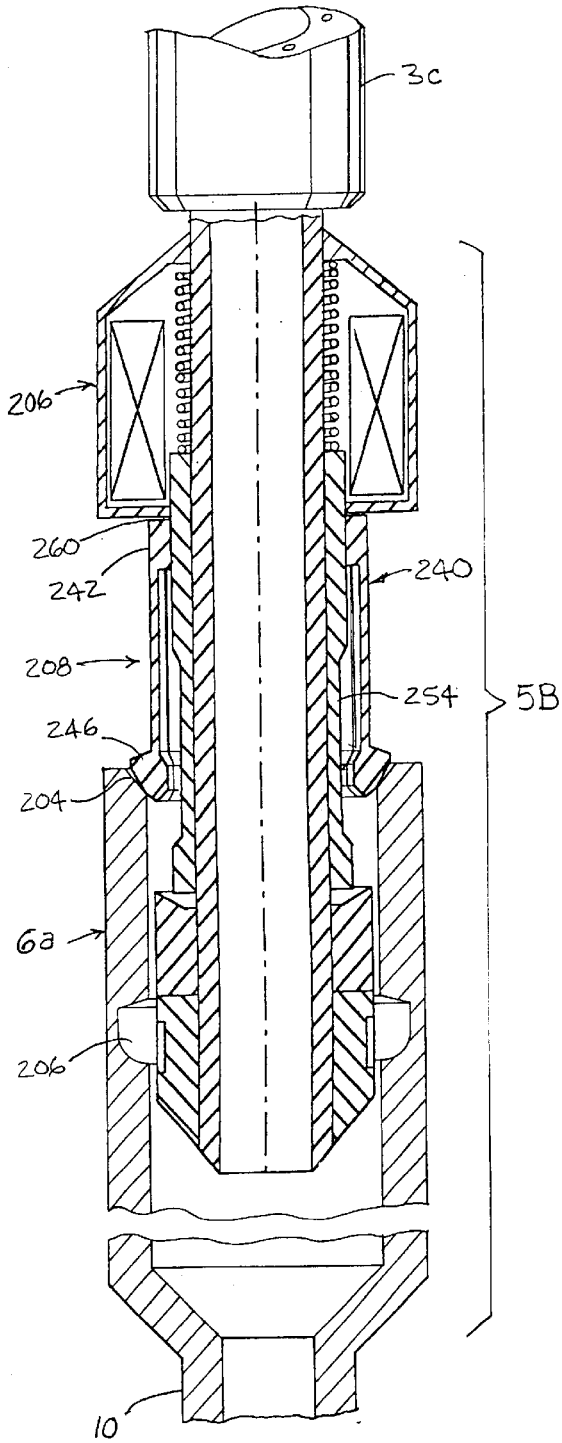

Sleeve 250 (when in the positions illustrated in FIGS. 5A–D) extends completely under collet portion 208 and into the solenoid. As illustrated the upper end 252 of sleeve 250 acts as the movable plunger of solenoid portion 206, however the sleeve 250 and plunger could be separate parts operably connected together. A compression spring 256 in solenoid portion 206 resiliently urges the sleeve 250 down against a lower cam ring 258. Sleeve 250 has a reduced diameter portion 254 positioned under collet portion 208. When the lock assembly 4 is moved toward portion 6*a*, locking tabs 246 on spring fingers 244 will engage tapered end 204 causing the collet portion 208 be forced to slide along the sleeve 250 form the position of FIG. 5A to the position shown in FIG. 5B. Relative axial movement is limited by engagement at 260 between the upper end of body portion 242 and lower end of the solenoid portion 206. As illustrated in FIG. 5B, the reduced diameter portion 254 is positioned under the locking tabs 246 allowing the spring fingers 244 to deflect radially inwardly.

Figure 5C:
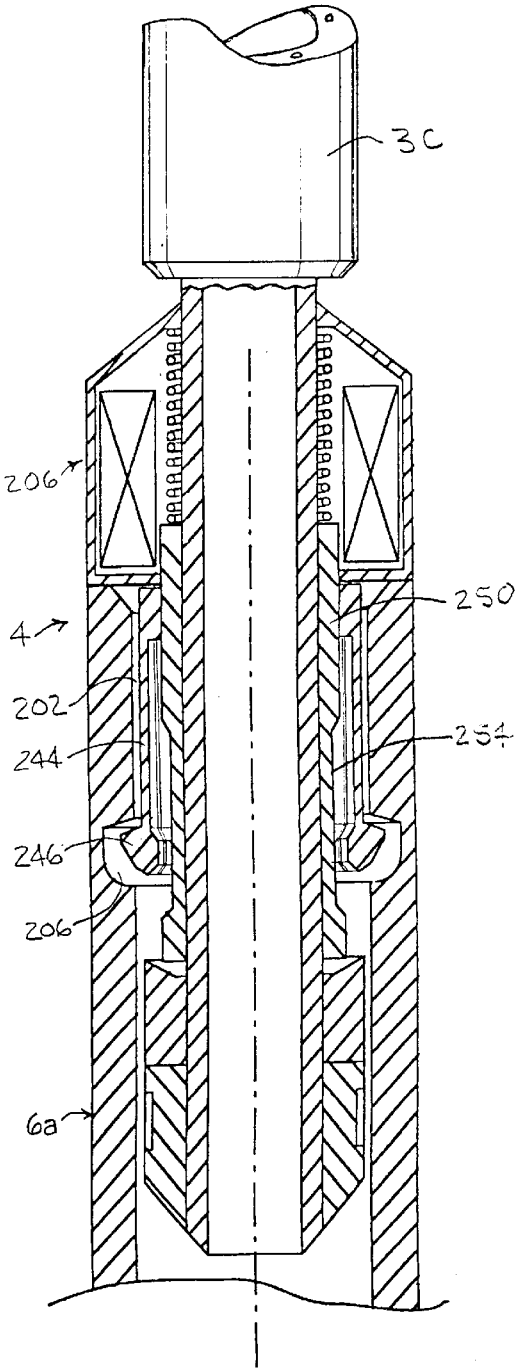
Figure 5D:
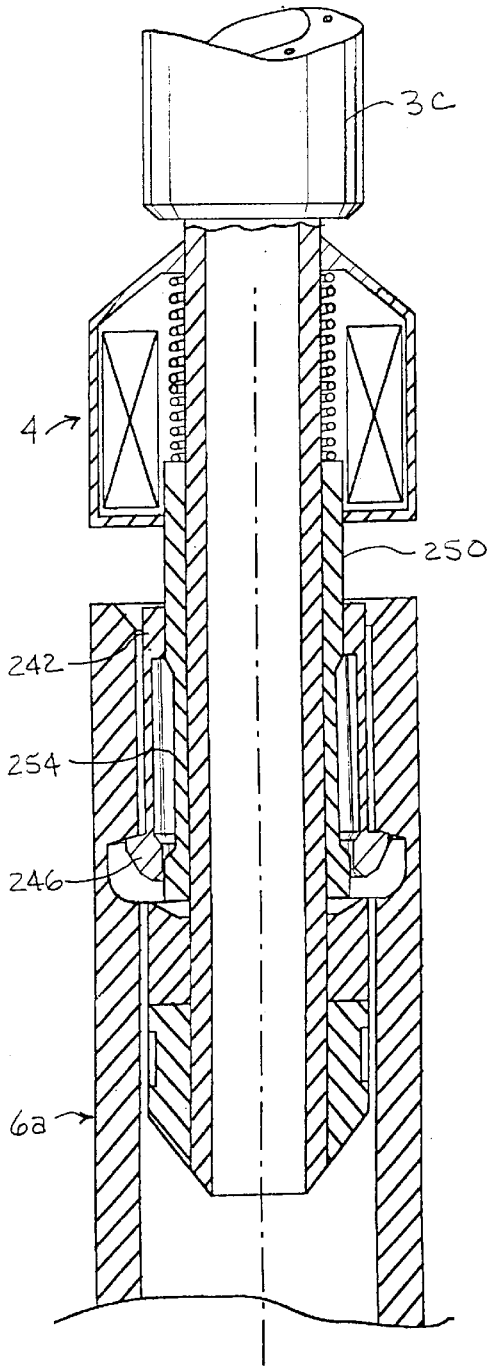

Applying a downward force on the latch assembly 4 will cause cam surfaces on the exterior of the locking tabs 246 to engage the tapered end 204 and force the spring fingers 244 to bend inwardly allowing the locking tabs to enter bore 202. As shown in FIG. 5C, further downward movement will allow the spring fingers 244 to move the locking tabs 246 to radially outwardly into groove 206 in bore 202. Corresponding locking surfaces on the groove 206 and upward facing surfaces of locking tabs 246 lock the assembly 4 in the portion 6*a*. As is illustrated in FIG. 5D, upward force applied to latch 4 will cause the reduced diameter portion 254 to move sleeve 250 out from under locking tabs 246 preventing their deflection out of grove 206. In this manner a sealed connection is formed between portion 6*a* and tubing 3*c*.

The unlatching operation is described by reference to FIG. 5E. Solenoid portion 206 has an electrical solenoid coil illustrated graphically as 208. Coil 208 has conductors 208*a* connected to conductors in tubing portion 3*c*. As previously described the conductors 208 are electrically connected to the conductors 8 in tubing 2. When electrical power is applied through conductors 208*a* to the coil 208 is energized causing sleeve 250 to move upward compressing spring 256 and moving the sleeve 250 and its lowermost end 259 from under locking tab 256. If upward force is applied to the latch assembly 4 the tabs will be caused to deflect into the bore 202 due to the engagement between cooperating cam surfaces on the lower ends of tabs 256 and upper end of cam ring 258. Once the locking tabs are free to deflect into the bore 202, latch 4 can removed and separated from the portion 6*a* and the entire tubing assembly spooled out of the well.

In FIG. 5E a transducer 300 is diagrammatically shown in the portion 3*c*. Transducer 300 is connected to conductors 302 in portion 3*c* which are in turn connected to conductors 8 leading to the controller. Transducer 300 can be any suitable electrical sensor such as for example a vibrating crystal pressure or temperature sensor. One or more transducers 300 could be located along the tubing assembly to monitor well conditions in the tubing and annulus to allow, for example, automatic closure of the TRSV when dangerous conditions are present or otherwise control well flow as desired. Transducers 300 could be located on the up and downhole sides of the TRSV to determine if it is effectively open or closed.

The descriptions above of various configurations of non-conductive tubing are meant to be exemplary and not limiting, and many other configurations are possible. Note also that although composite tube construction is preferred for use in accordance with the present invention because otherwise favorable strength and bending characteristics are more difficult to achieve when using nonconductive tubing (as opposed to, for example, steel tubing), it is not required. Finally, note that as used here, "non-conducting" tubing means essentially non-conducting, of course, and the presence of tubing components made from conductive materials that are not used to carry electrical or other energy to and from the TRSV, latch and sensors is nevertheless considered to fall within the scope of the present invention so long as the ability of the conductors in the tubing to supply power and conduct electrical signals is not frustrated thereby.

It is thus believed that the operation and construction of the present invention will be apparent from the foregoing description. While the various embodiments shown and described have been characterized as being preferred, it will be readily apparent that various changes and modifications could be made therein without departing from the scope of the invention as defined in the following claims.

What is claimed is:

1. A production assembly for use in a wellbore for extending from a surface location where electrical power is present to a first tubing terminating at a subterranean location in the wellbore, comprising:

a second length of tubing extending from the surface location to the first tubing in the wellbore, the second tubing having a wall formed of non-conductive material with at least one electrical conductor located in the non-conductive wall for conducting electrical energy axially along the second tubing;

an electrically operated valve assembly connected to the second tubing to control flow through the second tubing; the valve being electrically connected to the at least one electrical conductor for operating the valve from the surface location between an open and closed position in response to the provision of an electrical signal through the at least one conductor; and a connector forming a fluid connection at the subterranean location between the first and second tubing whereby when the valve is operated, flow through the first and second tubing is controlled from the surface location.

2. The assembly of claim 1 wherein the connector comprises an electrically operated latch assembly connected to the second tubing to selectively connect and release from the first tubing; the latch being electrically connected to the at least one electrical conductor for operating the latch from the surface location between a latched and an released position in response to the provision of an electrical signal through the at least one conductor whereby the first and second tubing can be connected and disconnected from the surface location.

3. The assembly of claim 1, further comprising a subterranean electrical transducer connected to said at least one electrical conductor for transmitting information in the form of electrical signals to the surface location through the at least one conductor.

4. The assembly of claim 1, wherein the electrically operated valve is a solenoid-actuated valve.

5. The assembly of claim 1, wherein the electrically operated valve is normally closed valve.

6. The valve assembly of claim 1, wherein the second tubing comprises composite tubing.

7. The assembly of claim 1, wherein the second tubing is made of spoolable material.

8. The assembly of claim 2, wherein the electrically operated latch is a solenoid-actuated valve.

9. The assembly of claim 1, further comprising means for connecting the at least one conductor to a power supply at the surface location.

10. The assembly of claim 2, further comprising means for connecting the at least one conductor to a power supply at the surface.

11. The assembly of claim 1, wherein the well is onshore.

12. The assembly of claim 1 wherein the well is located in water and the surface location is above the water surface.

13. The assembly of claim 1, wherein the at least one conductor is embedded in the non-conductive wall material of the second tubing.

14. The assembly of claim 1, additionally comprising a valve position sensor connected to the at least one electrical conductor for transmitting a valve position responsive signal to the surface location.

15. A safety system for use in a hydrocarbon well, comprising:

a hanger mounted in the well at a subterranean location;

a first production-tubing string supported at least in part by the hanger and extending downhole toward a producing zone of the well;

a second production tubing string connected to the first production tubing and extending to the well surface and wherein the second string is made of non conducting material, at least one electrical conductor enclosed within the wall of the second production-tubing string;

an electrically operated safety valve connected to the at least one electrical conductor, for selectively permitting flow between the first production tubing string and the second production tubing string; and a controller at the well surface connected to the conductor for selectively controlling supply of electrical power to the conductor.

16. The safety system of claim 15, wherein the electrically operated valve is a solenoid-actuated valve.

17. The safety system of claim 15, additionally comprising an electrically operated latch assembly connected to the second production tubing to selectively connect and release from the first production tubing; the latch being electrically connected to the at least one electrical conductor for operating the latch from the surface location between an latched and released position in response to the provision electrical power on the at least one conductor where by the first and second production tubing can be connected and disconnected.

18. The safety system of claim 15, further comprising an electrically operable valve position indicator.

19. The safety system of claim 15 where the second production tubing string is made from spoolable material.

20. A method of operating a downhole electrically operated safety valve for selectively controlling flow through a conduit, said method comprising the steps of:

providing a conduit portion made of a non-conductive spoolable material, wherein the wall of the conduit portion houses two insulated electrical conductors;

assembling the electric safety valve with the conduit portion with the conductors connected to the safety valve;

positioning the safety valve and conduit portion assembly at the well surface;

lowering the safety valve into the well to a downhole location by unspooling the conduit portion into the well;

selectively supplying power to the electrical conductors at the well surface; and operating the safety valve from the well surface by controlling the supply of power to the conductors in the conduit portion.

21. The method of operating a downhole safety valve of claim 20, wherein the conduit portion is a pipe for the production of hydrocarbons, and wherein the valve is biased to remain closed in the absence of supplied power.

22. The method of operating a downhole safety valve of claim 20, further comprising the step of monitoring the position of the safety valve.

23. The method of operating a downhole safety valve of claim 20, further comprising the step of providing a second conduit portion extending downhole from the safety valve.

24. The method of operating a downhole safety valve of claim 23, further comprising the step of installing a tubing hanger in the wellbore for supporting at least part of the weight of the second conduit portion.

25. A subsurface valve assembly for use in a well to connect to a production tubing string terminating in the well at a subterranean location, the assembly comprising;

an electrical controller located at a surface location;

an elongated tubular member formed of non conductive materials of sufficient length to reach from the subterranean location to the surface location, the tubular member comprising a wall defining a flow passage and having a plurality of axially extending electrical conductors contained in the wall of the tubular member and electrically connected to the electrical controller; and a valve assembly moveable between closed and open positions in response to the application of an electrical signal connected to the tubular member to control flow through the flow passage and electrically connected to the electrical conductors in the tubular member whereby the valve can be opened and closed from the surface controller.

26. A valve assembly for use in a well having a packer supporting a production tubing string at a subterranean location, the assembly comprising:

an electrical controller located at a remote location;

an elongated tubular member formed of non conductive materials of sufficient length to reach from the subterranean location to the remote location, the tubular member comprising a wall defining a flow passage and having electrical conductors embedded in the tubular member electrically connected to the electrical controller;

a valve assembly connected to the tubular member moveable between opened and closed positions in response to the application of an electrical signal connected to the tubular member to control flow through the flow passage and electrically connected to the electrical conductors in the tubular member; and an electrically operable tubing latch connected to the valve and electrically connected to the electrical conductors for releasably connecting to the subterranean tubing in the well.

* * * * *